US005820046A

United States Patent [19]

Nieminen

[11] Patent Number: 5,820,046

[45] Date of Patent: Oct. 13, 1998

[54] GRIPPING AND CUTTING DEVICE FOR A REEL

[75] Inventor: Mika Nieminen, Espoo, Finland

[73] Assignee: Nokia-Maillefer Holdings S.A., Switzerland

[21] Appl. No.: 873,775

[22] Filed: Jun. 12, 1997

[30] Foreign Application Priority Data

Jun. 27, 1996 [FI] Finland ..... 962661

[51] Int. Cl.[6] ..... B65H 54/00; B65H 49/00

[52] U.S. Cl. ..... 242/25 A; 242/128

[58] Field of Search ..... 242/25 A, 128

[56] References Cited

U.S. PATENT DOCUMENTS

| | | | |
|---|---|---|---|
| 3,952,960 | 4/1976 | Veyrassat | 242/25 A |
| 4,223,848 | 9/1980 | Brokke et al. | 242/25 A |
| 4,373,681 | 2/1983 | Crews et al. | 242/25 A |
| 4,438,886 | 3/1984 | Meisser et al. | 242/25 A |
| 4,552,314 | 11/1985 | Noguchi et al. | 242/25 A |
| 5,593,101 | 1/1997 | Varga | 242/25 A |

FOREIGN PATENT DOCUMENTS

| | | |
|---|---|---|
| 75323 | 2/1988 | Finland . |
| 7413413-1 | 3/1978 | Sweden . |
| 1 296 680 | 11/1972 | United Kingdom . |
| 1 476 216 | 6/1977 | United Kingdom . |

*Primary Examiner*—Michael Mansen
*Attorney, Agent, or Firm*—Nixon & Vanderhye P.C.

[57] ABSTRACT

An arrangement in connection with a spooler which is arranged to wind a reel arranged in the spooler when a fibrous or a ribbon-like material is wound off the reel for a treatment process of the fibre or the ribbon or when a fibrous or a ribbon-like material is wound on the reel, for preventing tangling. The arrangement includes a gripping and cutting mechanism that rotates along with the reel and is arranged to catch and cut the fibre or the ribbon that has broken during the process, at the side of the reel, thus preventing uncoiling and tangling of the reel during un-winding, or the whipping movement of the end of the fibre or the ribbon during winding.

4 Claims, 2 Drawing Sheets

GRIPPING AND CUTTING DEVICE FOR A REEL

BACKGROUND OF THE INVENTION

The invention relates to an arrangement in connection with a spooler which is arranged to wind a reel arranged in the spooler when a fibrous or a ribbon-like material is wound off the reel for a treatment process of the fibre or the ribbon or when a fibrous or a ribbon-like material is wound on the reel.

Arrangements of the above type are currently widely known especially in conjunction with treatment of optical fibres, ribbons or similar products. Spoolers and arrangements related to them are used e.g. in conjunction with coating the ribbons. Colouring of optical fibres or producing a surface layer to be added on top of a primary coating could be mentioned as an example of coating. The fibres may also naturally be other fibres than optical fibres.

Prior art solutions, however, are attended by some drawbacks, particularly in connection with unwinding. In winding a fibrous or a ribbon-like material off the reel, the problem is often caused by the fact that when a fibre or a ribbon breaks in the process after the reel, the reel will uncoil and tangle. This will result in material loss, and in the worst case the entire amount of material on the reel must be rejected, and in any case, the above situation will cause time-consuming disentangling work. In winding, similar problems will be caused by the end of the fibre or the ribbon whipping around after breaking.

In connection with prior art, the spool or the reel has been decelerated rapidly so that the material loss would be as small as possible. The risk of rapid deceleration, however, is the fact that the different spooling layers shift with respect to each other, which may result in loosing the entire material amount on the reel or spool.

BRIEF SUMMARY OF THE INVENTION

Accordingly, it is an object of the present invention to provide an arrangement by means of which the drawbacks of the prior art can be eliminated. This is achieved with an arrangement of the invention, which is characterized by comprising a gripping and cutting means that rotates along with the reel and is arranged to catch and cut a fibre or a ribbon that has broken during the process, at the side of the reel, thus preventing uncoiling and tangling of the reel during unwinding, or the whipping movement of the end of the fibre or the ribbon during winding.

An advantage of the invention, first of all, is its simplicity, as a result of which it is economically advantageous to take the invention into use. It is another advantage of the invention that the material loss will remain as small as possible as the reel or the spool cannot tangle and the only material loss will be that caused by the length in the process. Problems occurring previously in connection with the end of the fibre whipping around are also completely eliminated.

BRIEF DESCRIPTION OF THE SEVERAL VIEWS OF THE DRAWING

The arrangement of the invention will be described more in detail by means of a preferred embodiment with reference to the accompanying drawing in which.

DETAILED DESCRIPTION OF THE INVENTION

Figure 1:
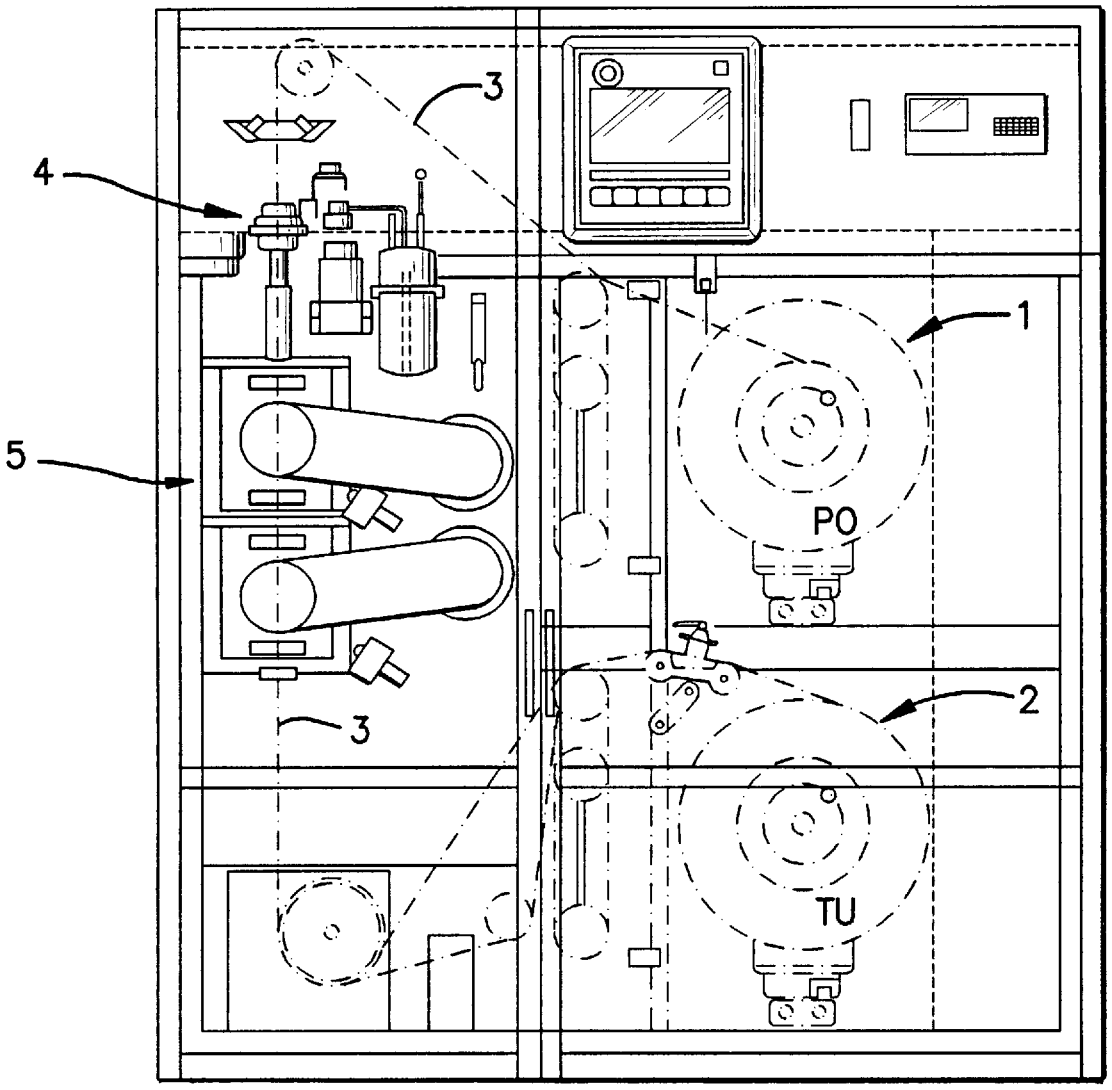
FIG. 1 shows a schematic side view of an apparatus used for coating a fibre and comprising a spooler which is used for unwinding and winding the fibre.

FIG. 1 shows a schematic diagram of an apparatus used for coating a fibre, in which the arrangement of the invention is applied. Reference number 1 refers to a pay-off reel, that is, the reel from which a fibre or a ribbon is led to the coating stage, and number 2 correspondingly denotes an take-up reel, that is, the reel on which the coated fibre is wound. The fibre or the ribbon is denoted with reference numeral 3 in FIG. 1. Means that are used for coating the fibre are generally marked with reference numeral 4. Devices used for hardening the coating are correspondingly marked with reference numeral 5. Devices 5 include e.g. ultraviolet lamps.

The means and devices described above and their operation are obvious to one skilled in the art, and they will thus not be paid closer attention to herein.

Figure 2:
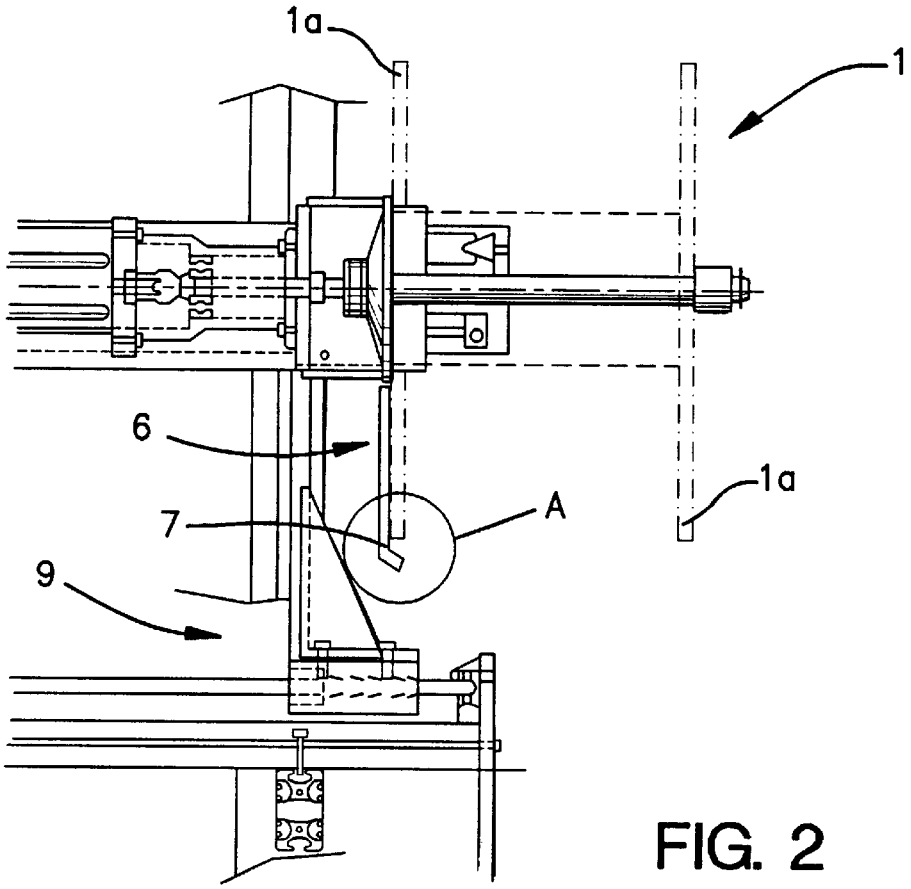
FIG. 2 is a schematic illustration of a detail of the spooler according to FIG. 1.

The arrangement of the invention particularly relates to a spooler which is arranged to wind a reel arranged in the spooler when a fibrous or a ribbon-like material 3 is wound off the reel for a treatment process of the fibre or the ribbon or when the fibre or the ribbon is wound on the reel. The above reel, that is, a pay-off reel, is marked in FIG. 1 with reference numeral 1. FIG. 2 shows the pay-off reel 1 and a spooler arranged in conjunction with it seen perpendicularly to the rotating axis of the reel. The flanges of reel 1 are marked in FIG. 2 with reference numeral 1*a*.

According to the essential idea of the invention, the arrangement comprises a gripping and cutting means 6 that rotates along with reel 1 and is arranged to catch and cut a fibre or a ribbon 3 that has broken during the process, at the side of reel 1, thus preventing uncoiling and tangling of reel 1, or the whipping movement of the end of the fibre or the ribbon 3. In the arrangement of the invention, the fibre or the ribbon 3 is thus caught to a catching means 6, i.e. the gripping and cutting means that rotates along with reel 1, and cut, whereby the reel or the spool cannot tangle during unwinding, and the material loss thus remains small, that is, it is only the length within the process that will be lost. During winding, again, whipping of the end of the fibre or the ribbon is prevented as the fibre or the ribbon is cut at the side of the reel.

Figure 3:
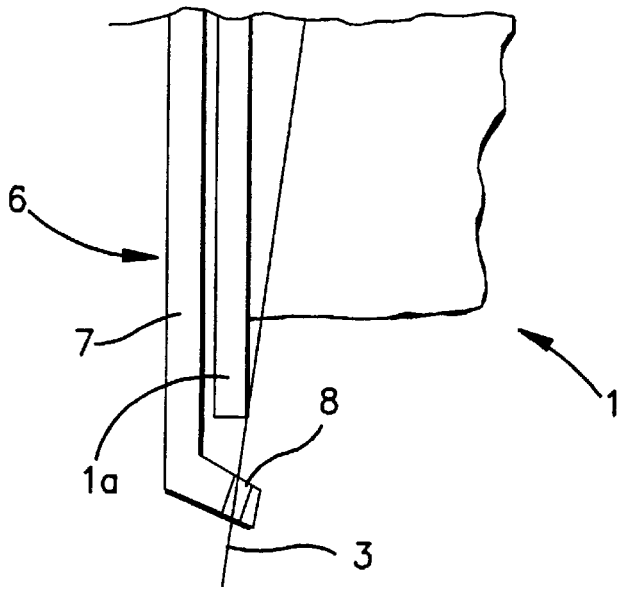
FIG. 3 shows detail A according to FIG. 2 on a larger scale.

In the embodiment shown in the Figures, the gripping and cutting means 6 that rotates along with the reel consists of an elongated arm 7 arranged alongside the flange 1*a*, whereby there is a groove 8 at the free end of the arm. When broken during the process, the fibre or the ribbon that runs off reel 1 is caught in the groove 8, whereby the fibre or the ribbon is also cut at the side of the reel, as stated above. The above structure is particularly apparent in FIG. 3.

When a solution with a movable reel (a traversing winding) is employed, a slide 9 is directed to the other extreme end as rapidly as possible in case the fibre breaks, whereby the fibre 3 will meet with the gripping and cutting means 6 that rotates along with the reel, said means both gripping the fibre and cutting the fibre at the side of the reel. If a spooler with a fixed reel is used, the fibre, when broken during the process, can be shifted to the gripping and cutting means rotating along with the reel by means of a movable lever means, or the like. The lever means is thereby arranged to grip on the fibre when it breaks in the process and to shift the fibre to the gripping and cutting means that rotates along with the reel.

The above embodiment is by no means intended to limit the above invention, but it may be freely modified within the scope of the claims. It is thus obvious that the arrangement of the invention or its details do not necessarily need to be exactly similar to those shown in the Figures, but solutions of other kinds are also possible.

I claim:

1. In a spooler assembly comprising at least one reel mounted for rotation in the spooler about a reel axis, the reel having a pair of flanges spaced along the reel axis, and arranged to pay out or wind up a fiber or ribbon; an improvement comprising: means for gripping and cutting an end of the fiber or ribbon which has broken, thereby preventing uncoiling and tangling of the reel during unwinding or whipping movement of the end of the fiber or ribbon during winding.

2. The improvement of claim 1 and further comprising a slide arranged to cause said end to engage said means.

3. In a spooler assembly comprising at least one reel mounted for rotation in the spooler about a reel axis, the reel having a pair of spaced flanges; the reel arranged to pay out or wind up a fiber or ribbon; an improvement comprising an elongated arm along one of said flanges and fixed for rotation with said reel, said elongated arm having a free end offset relative to said arm, said free end formed with a groove therein arranged to catch and cut a broken end of the fiber or ribbon, thereby preventing uncoiling and tangling of the reel during unwinding or whipping movement of the end of the fiber or ribbon during winding.

4. The improvement of claim 3 and further comprising a slide arranged to cause said end to engage said means.

* * * * *